United States Patent [19]

Holland et al.

[11] Patent Number: 4,999,869

[45] Date of Patent: Mar. 19, 1991

[54] PRE-TREATING TEXTILES WITH DISPERSIONS OF GRAFT POLYMERS BASED ON POLYALKYLENE OXIDES TO IMPART SOIL RELEASE PROPERTIES THERETO

[75] Inventors: Richard J. Holland, Grosse Ile; Alicia V. York, Detroit, both of Mich.; Ronald M. Ruppert, Moonachie, N.J.

[73] Assignee: BASF Corporation, Parsippany, N.J.

[21] Appl. No.: 417,317

[22] Filed: Oct. 5, 1989

[51] Int. Cl.[5] ..... D06M 15/53; C11D 3/37

[52] U.S. Cl. ..... 8/115.62; 8/115.56; 252/174.21; 252/174.23; 252/174.25; 252/DIG. 15

[58] Field of Search ..... 252/174.21, 174.23, 252/174.24, DIG. 15; 8/115.62, 115.56

[56] References Cited

U.S. PATENT DOCUMENTS

| | | | |
|---|---|---|---|
| 4,490,149 | 12/1984 | Saitou et al. | 8/539 |
| 4,846,994 | 7/1989 | Kud et al. | 252/174.21 |
| 4,846,995 | 7/1989 | Kud et al. | 252/174.21 |
| 4,875,901 | 10/1989 | Pay et al. | 8/115.56 |
| 4,904,408 | 2/1990 | Kud et al. | 252/174.24 |

OTHER PUBLICATIONS

Bille, et al. "Finishing for Durable Press & Soil Release," Taxtile Chemist and Colorist 1, vol. 1, No. 27(Dec. 31, 1969), pp. 600/23–607/30.

*Primary Examiner*—Paul Lieberman
*Assistant Examiner*—A. Beadles-Hay

[57] ABSTRACT

A process for the pre-treatment of textile surfaces which impart soil release properties, comprising contacting a textile with a dispersion graft copolymer of:

(a) a polyalkylene oxide which has a number average molecular weight of from 300 to 100,000, is based on ethylene oxide, propylene oxide and/or butylene oxide and may be capped at one end through etherification, esterification, amidation or reaction with a isocyanate, and (b) at least one vinyl ester derived from a saturated monocarboxylic acid containing 1 to 6 carbon atoms and/or a methyl or ethyl ester of acrylic or methacrylic acid in a weight ratio (a):(b) of from 1:0.2 to 1:10 in an aqueous liquor.

7 Claims, No Drawings

PRE-TREATING TEXTILES WITH DISPERSIONS OF GRAFT POLYMERS BASED ON POLYALKYLENE OXIDES TO IMPART SOIL RELEASE PROPERTIES THERETO

BACKGROUND OF THE INVENTION

1. Field of the Invention

The present invention relates to the use of a dispersion of a graft copolymer based on a polyalkylene oxide as a pre-treatment for polyester/cotton and polyester fabric surfaces. The fabrics so treated exhibit improved dirty motor oil soil release properties when compared to fabrics which are not so treated.

The present invention further relates to pre-treatment of cotton fabrics and polyester fibers, which fibers are pre-treated with a graft copolymer based on a polyalkylene oxide, and then woven into a fabric composition. The textile so woven and pre-treated exhibits improved oily soil release properties over fabrics which have not been treated before being woven into a textile.

2. Description of the Prior Art

Kud et al, U.S. Pat. No. 4,746,456 disclose detergents which contain added graft copolymers which have an antiredeposition action and are obtainable by grafting polyalkylene oxides with vinyl acetate or vinyl propionate. The detergents of Kud et al are useful for creating a wash liquor for the washing of textiles and which prevents soil from redepositing on clean textile surfaces.

Williams et al, U.S. Pat. No. 3,563,795 disclose water soluble copolymers of maleic anhydride and vinyl acetate for use as soil release agents.

Dickson et al, U.S. Pat. No. 3,798,169 disclose polycarboxylate polymers as soil release agents in a dilute solution in the presence of a polyvinyl metal salt.

Dickson, U.S. Pat. No. 3,821,147 discloses compositions for imparting non-permanent soil release characteristics comprising an aqueous solution of polycarboxylate copolymer and a water soluble amine.

Dickson, U.S. Pat. No. 3,836,496 discloses polycarboxylate copolymers and polyacrylamides for use as detergent compositions.

Kakar et al, U.S. Pat. No. 4,007,305 disclose a method for imparting non-durable soil release and soil repellant properties to textile materials by treating the textile with a dissolved water soluble hydrophilic soil release polymer having carboxylic acid groups and a dispersed hydrophobic soil repellant fluoro chemical.

SUMMARY OF THE INVENTION

Fabrics woven from polyester fibers or consisting of blends of polyester and cotton fibers are often difficult to clean. Because polyester fibers are hydrophobic, they are difficult to wet in aqueous solution, and are relatively easy to stain with oily (lipophilic) soils. Textile manufacturers have addressed this problem by applying surface finishes to these fabrics. These surface coatings are often hydrophilic in nature and can enhance the wetting of the fabric by detergent solutions thus promoting the rollup of oily soils. In addition, the fiber coating can act as a barrier between the surface and the soil.

Surface finishes can be applied to textiles in a variety of ways. Often, an aqueous bath is employed in the pre-treatment process with polymer concentrations ranging from 0.05–15% active. In some cases, a non-permanent coating can be deposited in the rinse cycle of a conventional laundry process. In instances where a more permanent finish is required, the overlayer can be "heat set" to the fabric by drying at elevated temperatures often with mechanical pressure on the textile.

The present invention is a dispersion of a graft copolymer based on polyalkylene oxides which are used to pre-treat polyester/cotton and polyester fabric surfaces. The fabric surfaces so treated exhibit improved dirty oil soil release properties when compared to fabrics which are not pre-treated.

DETAILED DESCRIPTION OF THE PREFERRED EMBODIMENT

It has been discovered that dispersions of a polyethylene oxide (PEO)/vinyl acetate graft copolymer in water (20%, or 5% active) impart dirty motor oil soil release properties to fabrics which contain polyester; single knit filament polyester, staple polyester and D(65)/C(35) blends. Significantly, it has also been observed that PEO/vinyl propionate graft copolymers impart a soil release finish at even lower concentrations (5% active) when applied to these fabrics from a (95%/5%) (ethanol/water) dispersion.

It is an object of the present invention to provide polymeric additives for the pre-treatment of goods containing synthetic/natural fiber blends and synthetic fibers. We have found that this object is achieved, in accordance with the invention, by the use of graft copolymers which are obtainable by grafting (a) a polyalkylene oxide which has a number average molecular weight of from 300 to 100,000, is based on ethylene oxide, propylene oxide and/or butylene oxide and may be capped at at least one end, by etherification, esterification, amidation, or reaction with an isocyanate, with (b) at least one vinyl ester derived from a saturated monocarboxylic acid containing 1 to 6 carbon atoms and/or a methyl or ethyl ester of acrylic or methacrylic acid in a weight ratio (a):(b) of from 1:0.2 to 1:10 and whose grafted-on monomer (b) may optionally be hydrolyzed up to 15 mole percent.

The products to be used according to the invention are known for example from GB Patent 922,457. The graft bases used are the polyalkylene oxides specified above under (a), which have a number average molecular weight of 300 to 100,000, are based on ethylene oxide, propylene oxide and/or butylene oxide and may be capped at at least one end. Preference is given to using homopolymers of ethylene oxide or ethylene oxide copolymers having an ethylene oxide content of from 40 to 99 mole percent. For the ethylene oxide polymers which are preferably used, the proportion of ethylene oxide present as copolymerized units is thus from 40 to 100 mole percent. Suitable comonomers for these copolymers are propylene oxide, n-butylene oxide and/or isobutylene oxide. Suitable copolymers are those of ethylene oxide and propylene oxide, copolymers of ethylene oxide and butylene oxide, and also copolymers of ethylene oxide, propylene oxide and at least one butylene oxide. The ethylene oxide content of the copolymers is preferably from 40 to 99 mole percent, the propylene oxide content from 1 to 60 mole percent and the butylene oxide content in the copolymers from 1 to 30 mole percent. Aside from straight-chain, it is also possible to use branched homopolymers or copolymers which may be end group capped, at at least one end, as a graft base. Branched copolymers may be prepared by addition of ethylene oxide with or without propylene oxide and/or butylene oxides onto polyhydric, low molecular weight alcohols, such as, trimethylolpropane, glycerol, pentoses or hexoses and mixtures thereof. The alkylene oxide unit can be randomly distributed in the polymer or be present therein as blocks. One or more terminal OH groups of the polyalkylene oxides can be end group capped. This is to be understood as meaning that it may be etherified, esterified, aminated or modified by reaction with an isocyanate.

In the case of etherification, suitable substituents for the terminal hydrogen atoms of the hydroxyl groups on the polyalkylene oxides are alkyl groups having 1 to 18 carbon atoms, substituted alkyl, such as benzyl, or even phenyl. Polyalkylene oxides whose end groups are esterified may be obtained by esterifying the above-described polyalkylene oxides with carboxylic acids of 1 to 18 carbon atoms, for example by reaction with formic acid, acetic acid, propionic acid, butyric acid, malonic acid, succinic acid, stearic acid, maleic acid, terephthalic acid or phthalic acid. If carboxylic anhydrides are available, the end group cap on the polyalkylene oxides can also be obtained by reaction with the corresponding anhydrides, such as maleic anhydride. The polyalkylene oxides can also be modified at at least one end by reaction with isocyanates, such as phenyl isocyanate, naphthyl isocyanate, methyl isocyanate, ethyl isocyanate or stearyl isocyanate and mixtures thereof.

Aminated products are obtained by autoclave reaction of the corresponding alkylene oxide with amines such as $C_1$–$C_{18}$-alkylamines.

Component (b) comprises vinyl esters derived from a saturated monocarboxylic acid containing 1 to 6 carbon atoms, and also methyl acrylate, ethyl acrylate, methyl methacrylate, ethyl methacrylate and mixtures thereof. Suitable vinyl esters may be selected from the group consisting of vinyl formate, vinyl acetate, vinyl propionate, vinyl butyrate, vinyl valerate, vinyl i-valerate and vinyl caproate. Of the monomers of group (b), preference is given to using vinyl acetate, vinyl propionate, methyl acrylate, methyl methacrylate and mixtures thereof.

The graft copolymers are prepared in a conventional manner, such as by grafting the polyalkylene oxides of component (a), which may be end group capped at at least one end, with the monomers of component (b) in the presence of free radical initiators or by the action of high-energy radiation, which includes the action of high-energy electrons. This can be done by dissolving component (a) in at least one monomer of group (b), adding a polymerization initiator and polymerizing the mixture to completion. The graft copolymerization can also be carried out semicontinuously by first introducing only a part, for example 10%, of the mixture of end group capped polyalkylene oxide to be polymerized, at least one monomer of group (b) and an initiator, heating to polymerization temperature and, after the polymerization has started, adding the remainder of the mixture to be polymerized at a rate comensurate with the rate of polymerization. The graft copolymers can also be obtained by introducing polyalkylene oxides of group (a) into a reactor, heating to the polymerization temperature and adding at least one monomer of group (b) and polymerization initiator either all at once, a little at a time, or preferably, uninterruptedly and polymerizing to completion. The weight ratio of components (a):(b) is from 1:0.2 to 1:10, preferably from 1:0.5 to 1:6.

Suitable polymerization initiators are, in particular, organic peroxides, such as diacetyl peroxide, dibenzoyl peroxide, succinyl peroxide, di-tert-butyl peroxide, tert-butyl perbenzoate, tert-butyl perpivalate, tert-butyl permaleate, cumene hydroperoxide, diisopropyl peroxodicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, and mixtures thereof, redox initiators and azo starters and mixture thereof.

The graft polymerization takes place at from 50° to 200° C., preferably at from 70° to 140° C. It is customarily carried out under atmospheric pressure, but can also be carried out under reduced or superatmospheric pressure. If desired, the graft copolymerization described above can also be carried out in a solvent. Suitable solvents are, for example, alcohols, e.g. methanol, ethanol, n-propanol, isopropanol, n-butanol, sec-butanol, tert-butanol, n-hexanol and cyclohexanol and mixture thereof; and also glycols, such as ethylene glycol, propylene glycol and butylene glycol, and also the methyl or ethyl ethers of dihydric alcohols, diethylene glycol, triethylene glycol, glycerol and dioxane and mixtures thereof. The graft polymerization can also be carried out in water as solvent. In this case, the first step is to introduce a solution which, depending on the amount of added monomers of component (b), is more or less soluble in water, and can take on a dispersion character. To transfer any water-insoluble products which form during the polymerization into solution, it is possible to add organic solvents such as monohydric alcohols having 1 to 3 carbon atoms, acetone or dimethylformamide and mixtures thereof. However, in the graft polymerization in water, it is also possible to transfer the water-insoluble graft polymers into a finely divided dispersion by adding customary emulsifiers or protective colloids, such as polyvinyl alcohol. The emulsifiers used may be selected from the group consisting of ionic or nonionic surfactants whose HLB value is within the range from 3 to 13. For the definition of the HLB value reference is made to the paper by W. C. Griffin in J. Soc. Cosmet. Chem. 5 (1954), 249. The amount of surfactant, based on the graft polymer, is from 0.1 to 5% by weight. If water is used as the solvent, solutions or dispersions of graft polymers are obtained. If solutions of graft polymers are prepared in an organic solvent or in mixtures of an organic solvent and water, the amount of organic solvent or solvent mixture used per 100 parts by weight of the graft polymer is from 5 to 200, preferably from 10 to 100, parts by weight.

The graft polymers have a K value of from 5 to 200, preferably from 5 to 50 (determined according to H. Fikentscher in 2% strength by weight solution in dimethylformamide at 25° C.). After the graft polymerization, the graft polymer may optionally be subjected to a partial hydrolysis where up to 15 mole percent of the grafted-on monomers of component (b) are hydrolyzed. For instance, the hydrolysis of graft polymers prepared using vinyl acetate as preferred monomers of group (b) gives graft polymers containing vinyl alcohol units. The hydrolysis can be carried out by adding a base, such as a sodium hydroxide solution, potassium hydroxide solution, ammonia or amines, such as triethanolamine, morpholine or triethylamine, and mixtures thereof or alternatively, by adding acids, such as HCL, and if necessary, heating the mixture.

The graft copolymers are useful as additives in the pre-treatment of goods containing synthetic and synthetic/natural fiber blends. Specifically, the textiles to be treated may be coated in a bath containing aqueous, or organic solvents, and employing polymer concentrations of from about 0.05–15% active. The textile is immersed in the bath, and the polymer is deposited onto the fabric. The polymer may be heat set to the fabric by drying at a temperature of at least 100° C.

The following examples are given to illustrate various aspects of the invention. Those skilled in the art recognize that they are not to be construed as limiting the scope and spirit of the invention.

In the Examples, the following test methodology was used.

Three fabric types (5 replicates of each) were soaked in a dispersion of the graft copolymer for 10 minutes at room temperature, removed from the bath and placed on a metal rack. The swatches were dried with a heat gun and placed between two pieces of aluminum foil. Each fabric was pressed with a clothes iron (setting = 5; cotton) for two minutes on each side and allowed to cool. Three drops of dirty motor oil (obtained from a 1975 Ford Granada) were added to each swatch and the stain was allowed to wick overnight. Reflectance readings were taken with a Gardner colorimeter for each stained fabric ($Rd_2$). The swatches were washed at 120° F. in Wyandotte tap water using a Whirlpool Imperial washer (17 gallons). A ten minute cycle was employed and ¼ cup of FRESH START laundry detergent was added to clean the swatches. The fabrics were dried for 30 minutes in a Whirlpool Imperial dryer and reflectance readings for the washed swatches ($Rd_3$) were measured. Standard clean swatches were used to determine an initial reflectance value ($Rd_1$) for each fabric type. Percent soil release (% SR) was calculated using these three reflectance values ($Rd_1$, $Rd_2$ and $Rd_3$) as follows:

$$(Rd_3 - Rd_2)/(Rd_1 - Rd_2) \times 100 = \%\ SR$$

where $Rd_1$ = the reflectance of the virgin fabric $Rd_2$ = the reflectance of the stained fabric $Rd_3$ = the reflectance of the washed fabric In Table I, we show data obtained with fabrics that were pre-treated with a 20% dispersion of SOKALAN® HP-22 (a PEO/vinyl acetate graft copolymer) in water. Least significant differences at 95% confidence are shown in parenthesis. As the table indicates, a 20% dispersion of SOKALAN® HP-22 in water provided significant soil release on cotton, staple polyester and D(65)/C(35) blend fabrics. A very high loading of polymer was required to achieve 100% SR on these fabrics, however.

Additional experiments were carried out at lower dispersion concentrations (5% PEO/vinyl acetate). In this study, the PEO/vinyl acetate (PEO/VAc) graft was compared to a PEO/vinylpropionate (PEO/VPr) graft copolymer. The PEO/VPr graft was applied from a (95/5) (ethanol/water) dispersion. Results shown in Table II indicated better performance for the PEO/VPr graft than for the PEO/vinyl acetate on filament polyester, staple polyester, and D(65)/C(35) blend fabrics.

Since both PEO/VAc and PEO/VPr impart soil release properties to polyester containing textiles, these copolymers could be used alone or in conjunction with other compounds to prevent oily stains from setting in.

TABLE I

Pre-treatment with a 20% Dispersion of PEO/Vinyl Acetate Graft Copolymer in Water

| | Fabric Type | | |
|---|---|---|---|
| | Cotton (S-405) | Staple Poly. (S-767) | Blend (S-7435) |
| 20% PEO/vinyl acetate in Water | 86.8% (1.9%) | 98.1% (0.8%) | 98.1% (0.4%) |
| No Pre-treatment | 33.8% (3.8%) | 5.1% (0.6%) | 10.6% (1.5%) |
| Advantage Over The Control | +53.0% | +93.0% | +87.5% |

95% confidence intervals are shown in parenthesis.

TABLE II

Comparison of Pre-treatment with PEO/Vinyl Acetate and PEO/VPr Graft Copolymers

| | Fabric Type | | |
|---|---|---|---|
| | Single Knit Poly. (S-730) | Staple Poly. (S-767) | D(65)/C(35) (S-7435) |
| 5% PEO/Vinyl Acetate in Water | 37.0% (6.1%) | 16.6% (3.1%) | 55.0% (5.1%) |
| No Pre-treatment | 6.5% (1.3%) | 8.3% (0.5%) | 10.9% (8.3%) |
| Advantage Over The Control | +31.5% | +8.3% | +44.1% |
| PEO/VPr 5% Active Disper. In 95/5 EtOH/$H_2O$ | 84.7% (3.5%) | 48.0% (3.9%) | 75.4% (6.4%) |
| Advantage Over The Control | +78.2% | +39.7% | +64.5% |

95% confidence intervals are shown in parenthesis.

We claim:

1. A process for the pre-treatment of textile surfaces to impart soil release properties to the textile comprising contacting a textile with a dispersion of a graft copolymer of:
   (a) a polyalkylene oxide which has a number average molecular weight of from 300 to 100,000, is based on ethylene oxide, propylene oxide and/or butylene oxide, with
   (b) at least one vinyl ester derived from a saturated monocarboxylic acid containing 1 to 6 carbon atoms and/or a methyl or ethyl ester of acrylic or methacrylic acid in a weight ratio (a):(b) of from 1:0.2 to 1:10 in an aqueous liquor.

2. The process of claim 1 wherein the vinyl ester (b) is hydrolyzed up to 15 mole percent.

3. The process of claim 1 wherein the textile is treated with a 20% dispersion of the graft copolymer.

4. The process of claim 1 wherein said graft copolymer is heat set onto the textile surface.

5. The process of claim 1 wherein said aqueous liquor is comprised of water and a copolymer solvent.

6. The process of claim 5 wherein said solvent is a monohydric alcohol.

7. The process of claim 1 wherein the polyoxyalkylene oxide (a) is end capped through esterification, etherification, amidation or reaction with an isocyanate.

* * * * *